US011423730B2

(12) United States Patent
Williams

(10) Patent No.: US 11,423,730 B2
(45) Date of Patent: Aug. 23, 2022

(54) LOCK AND APPARATUS COMPRISING THE SAME

(71) Applicant: IDEAS FOR LIFE LIMITED, Sheffield (GB)

(72) Inventor: Richard Williams, Sheffield (GB)

(73) Assignee: IDEAS FOR LIFE LIMITED, Sheffield (GB)

( * ) Notice: Subject to any disclaimer, the term of this patent is extended or adjusted under 35 U.S.C. 154(b) by 176 days.

(21) Appl. No.: 16/637,686

(22) PCT Filed: Jul. 25, 2018

(86) PCT No.: PCT/GB2018/052093

§ 371 (c)(1),
(2) Date: Feb. 7, 2020

(87) PCT Pub. No.: WO2019/030470

PCT Pub. Date: Feb. 14, 2019

(65) Prior Publication Data

US 2020/0202656 A1 Jun. 25, 2020

(30) Foreign Application Priority Data

Aug. 10, 2017 (GB) ..... 1712848
Sep. 21, 2017 (GB) ..... 1715246

(51) Int. Cl.
*G07D 11/125* (2019.01)

(52) U.S. Cl.
CPC ..... *G07D 11/125* (2019.01)

(58) Field of Classification Search
CPC ..... G07D 11/125
See application file for complete search history.

(56) References Cited

U.S. PATENT DOCUMENTS

| | | | | |
|---|---|---|---|---|
| 7,909,198 | B2 * | 3/2011 | Lewis | B65H 29/46 220/345.2 |
| 8,434,673 | B2 * | 5/2013 | Johnson | G07D 11/125 232/1 D |
| 2006/0269169 | A1 * | 11/2006 | Kettner | B65D 33/34 383/5 |
| 2010/0308055 | A1 * | 12/2010 | Sams | B65D 43/169 220/324 |
| 2020/0364962 | A1 * | 11/2020 | Larose | G08B 13/1454 |

FOREIGN PATENT DOCUMENTS

| | | | |
|---|---|---|---|
| EP | 1839281 | B1 | 10/2007 |
| GB | 2455558 | A | 6/2009 |
| WO | 0219289 | A2 | 3/2002 |

* cited by examiner

*Primary Examiner* — Christle I Marshall
(74) *Attorney, Agent, or Firm* — Craft Chu PLLC; Andrew W. Chu

(57) ABSTRACT

A lock apparatus includes a carrier and lid, the carrier being adapted to receive bank notes and having side portions into which the lid can be slid to prevent access to the bank notes in the carrier. The side portions of the carrier having mechanisms for engaging with side portions of the lid. The lid has a leading edge including a first member shaped to form an irreversible lock with a correspondingly shaped second member on the carrier. One of the first and second members includes a male member and the other of the first and second members includes a female member.

17 Claims, 12 Drawing Sheets

LOCK AND APPARATUS COMPRISING THE SAME

CROSS-REFERENCE TO RELATED APPLICATIONS

See Application Data Sheet.

STATEMENT REGARDING FEDERALLY SPONSORED RESEARCH OR DEVELOPMENT

Not applicable.

THE NAMES OF PARTIES TO A JOINT RESEARCH AGREEMENT

Not applicable.

INCORPORATION-BY-REFERENCE OF MATERIAL SUBMITTED ON A COMPACT DISC OR AS A TEXT FILE VIA THE OFFICE ELECTRONIC FILING SYSTEM (EFS-WEB)

Not applicable.

STATEMENT REGARDING PRIOR DISCLOSURES BY THE INVENTOR OR A JOINT INVENTOR

Not applicable.

BACKGROUND OF THE INVENTION

1. Field of the Invention

This invention relates to a lock, in particular to a lock suitable for use with an apparatus for the tamper proof storage and transportation of banknotes or other items, and to such an apparatus comprising the lock.

2. Description of Related Art Including Information Disclosed Under 37 CFR 1.97 and 37 CFR 1.98

It is known to provide portable banknote carriers into which notes can be inserted but not subsequently withdrawn without leaving evidence that there has been tampering. Carriers of this type are commonly used at tills where for security cashiers can insert banknotes when the stack of notes in a till exceeds a particular level, then at periodic intervals or the end of the day the carriers are locked, removed from their location at the till, marked with the till identification and handed over for counting and banking.

With such a system it is not necessary for the cashier to count the money put into the carrier because it will be evident if there had been tampering after the carrier has left the till. Nowadays it is often preferred for the carriers to be counted at an 'out of house' central accounting location or bank that may be remote from the original cashier's location. The carrier may be handled by individuals from different organisations such as security transportation firms. Thus, as well as requiring resistance to tampering, the carrier and its lid are preferably lightweight and recyclable, due to the cost and inconvenience of returning carriers.

Published European Patent Application EP 1314144 A1 describes one such system, in which a carrier is locked in place in a support structure for receipt of banknotes and when it is required to remove the carrier this can only be done after a tamper-proof lid has been inserted over the carrier. The mechanism is designed so that during the procedure of attaching the lid and subsequent removal of the carrier from the supporting structure it is not possible to remove notes. The lid slides over the carrier in one direction only and there are end stops that lock when the lid is fully engaged, and at that point release from the support structure is enabled. Access to the carrier requires breakage of the end stops so that the lid can be slid, in the same single direction, off the carrier at the opposite end from which it was introduced.

It was found, however, that the channels of the lid and carrier top in such an arrangement, when made thin or of some plastics materials, had sufficient flexibility for them to be prized apart and notes removed without leaving evidence of tampering. It is clearly desirable to make sure this cannot happen, without having to make the relevant parts of thicker or different materials. Indeed it is preferable to be able to make the parts thinner in some instances, or of more easily recyclable materials, improved arrangements were developed, such as disclosed in published European Patent EP 1839281 B1. This comprises an apparatus comprising a carrier and lid, the carrier being adapted to receive bank notes and having side portions into which the lid can be slid to prevent access to the bank notes in the carrier, the side portions of the carrier having means for engaging with side portions of the lid, wherein the means for engaging overlap said side portions of the lid in the 'vertical' direction normal to the plane of the lid to resist separation in said direction of the lid and carrier at their side margins.

BRIEF SUMMARY OF THE INVENTION

The present invention arose during development of a yet further improved apparatus for the tamper proof storage and transportation of banknotes. It should be noted that whilst the apparatus of the present invention is provided with the storage and transport of bank notes in mind, the apparatus may be used (or adapted within the scope of the claims) for the tamper proof storage and transport of other items, including but not limited to other forms of payment slips (postal orders, cheques, credit card slips, coupons and or pre-paid vouchers), for example. In a similar regard, it should be appreciated that the lock may find application beyond the field of bank note storage and transportation.

According to the present invention in a first aspect, there is provided an apparatus comprising a carrier and lid as recited by claim 1.

According to the present invention in further aspects, there are provided:

An apparatus comprising a carrier and lid, the carrier being adapted to receive bank notes, or other items, and having side portions into which the lid can be slid to prevent access to the bank notes, or other items, in the carrier, the side portions of the carrier having means for engaging with side portions of the lid, the lid having a leading edge comprising a first member shaped to form an irreversible lock with a correspondingly shaped second member on the carrier, one of the first and second members comprising a male member and the other of the first and second members comprising a female member, wherein the female member comprises a mouth for receiving the male member and a shield, which projects from the mouth.

An apparatus comprising a carrier and lid, the carrier being adapted to receive bank notes, or other items, and having side portions into which the lid can be slid to prevent access to the bank notes, or other items, in the carrier, the side portions of the carrier having means for engaging with side portions of the lid, the lid having a leading edge comprising a first member shaped to form an irreversible lock with a correspondingly shaped second member on the carrier, one of the first and second members comprising a male member and the other of the first and second members comprising a female member, wherein a surface of the lid that faces the carrier comprises a recess immediately adjacent to the first member.

An apparatus comprising a carrier and lid, the carrier being adapted to receive bank notes, or other items, and having side portions into which the lid can be slid to prevent access to the bank notes, or other items, in the carrier, the side portions of the carrier having means for engaging with side portions of the lid, the lid having a leading edge comprising a first member shaped to form an irreversible lock with a correspondingly shaped second member on the carrier, one of the first and second members comprising a male member and the other of the first and second members comprising a female member, wherein the female member comprises a mouth for receiving the male member and a barrier is provided inside the female member immediately adjacent the mouth.

An apparatus comprising a carrier and lid, the carrier being adapted to receive bank notes, or other items, and having side portions into which the lid can be slid to prevent access to the bank notes, or other items, in the carrier, the side portions of the carrier having means for engaging with side portions of the lid, the lid having a leading edge comprising a first member shaped to form an irreversible lock with a correspondingly shaped second member on the carrier, one of the first and second members comprising a male member and the other of the first and second members comprising a female member, wherein the male and female members each comprise a serrate part, which projects in a direction normal to the plane of the lid when the lid and the carrier are engaged, the serrate parts of the male and female members being positioned to engage one another to prevent withdrawal of the lid from the carrier, wherein the female member comprises a mouth for receiving the male member and a barrier is provided inside the female member, and wherein the serrate part of the female member projects from the same surface as the barrier and is located inside the female member from the barrier.

An apparatus comprising a carrier and lid, the carrier being adapted to receive bank notes, or other items, and having side portions into which the lid can be slid to prevent access to the bank notes, or other items, in the carrier, the side portions of the carrier having means for engaging with side portions of the lid, the lid having a leading edge and a trailing edge, the leading edge comprising a first member shaped to form an irreversible lock with a correspondingly shaped second member on the carrier, one of the first and second members comprising a male member and the other of the first and second members comprising a female member, and the trailing edge comprising a third member shaped to form an irreversible lock with a correspondingly shaped fourth member on the carrier, one of the third and fourth members comprising a male member and the other of the third and fourth members comprising a female member, and a cover fixed to the lid for covering the third member to prevent access thereto.

It is to be noted that any of the above aspects may be taken in isolation or in combination with any one, more or all of the remaining aspects.

Further, preferred, features are presented in the dependent claims.

BRIEF DESCRIPTION OF THE SEVERAL VIEWS OF THE DRAWINGS

Embodiments of the invention are described below with reference to the accompanying drawings.

DETAILED DESCRIPTION OF THE INVENTION

FIGS. 1 to 8 relate to known prior art apparatus in accordance with that shown in EP 1839281 B1. The entire contents of EP 1839281 B1 are incorporated herein by reference. It is to be noted that whilst the apparatus of the example omits features of the lock as required by the present invention, in accordance with embodiments of the present invention, the example apparatus will be modified to include the required lock, as described with reference to the embodiments of FIGS. 9 to 12, by suitable modification/replacement of the first insert 75 and second insert 93 (described below). Such an apparatus, in accordance with the present invention, may be further modified in accordance with the features omitted here but disclosed in Published British Patent Application GB 2455558 A, the contents of which are also incorporated herein by reference.

Figure 1:
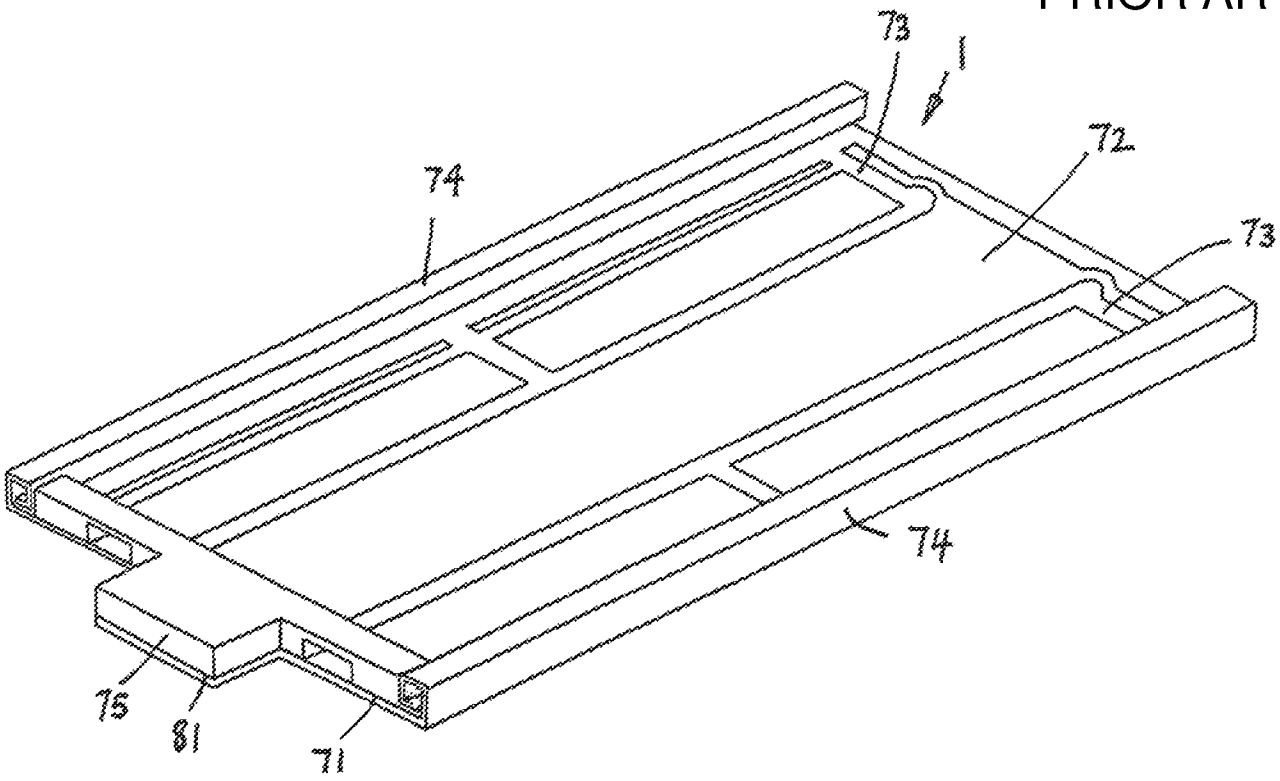
FIG. 1 PRIOR ART
FIG. 1 is a perspective view of a known prior art carrier.

FIG. 1 is a perspective view of a carrier 1 according to the prior art. It comprises a flat base 71 which has a large central longitudinal aperture 72 and two side flaps 73, which are apertured to reduce material and to make them more flexible. At each side margin of the base is a respective one of two box-section longitudinal channels 74 to be further described with reference to FIG. 5. The channels fully embrace the corresponding side portions of the lid (shown in FIG. 3). At the forward end of the carrier is a first insert 75 which spans the carrier between the leading ends of the channels 74.

Figure 2:
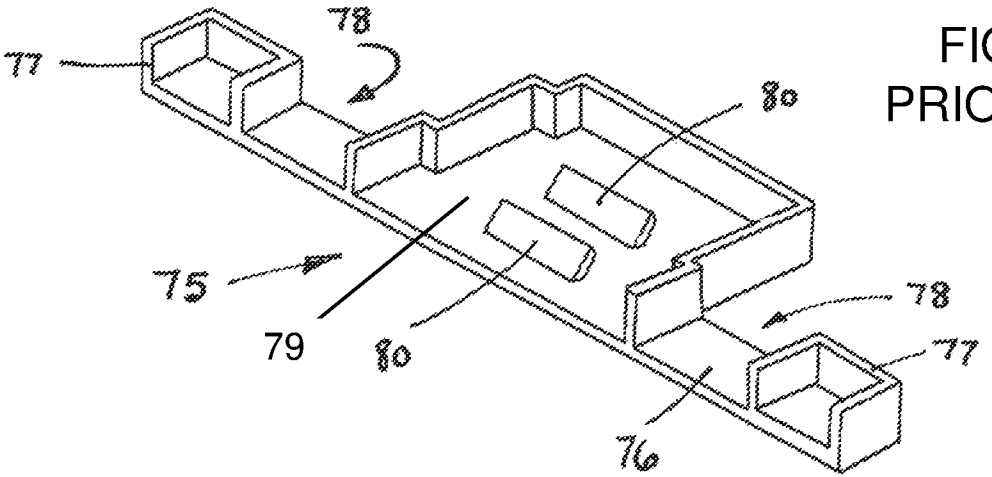
FIG. 2 PRIOR ART
FIG. 2 is a perspective view of part of the known prior art carrier shown in FIG. 1.

FIG. 2 shows the first insert 75 (upturned from its orientation in FIG. 1), which is comprised of a first elongate plate 76 having integral therewith an open side box section 77 at each end, partly to add strength, partly to receive forward projections of a lid 5 and partly to define a respective aperture 78 with a central open box section 79. Within the central box section 79 and disposed on the plate 76, raised serrations 80 extend substantially in the 'vertical' direction. The central box section 79 fits over a correspondingly sized and shaped front tab 81 (FIG. 1) extending forwardly from the base 71 of the carrier 1.

Figure 3:
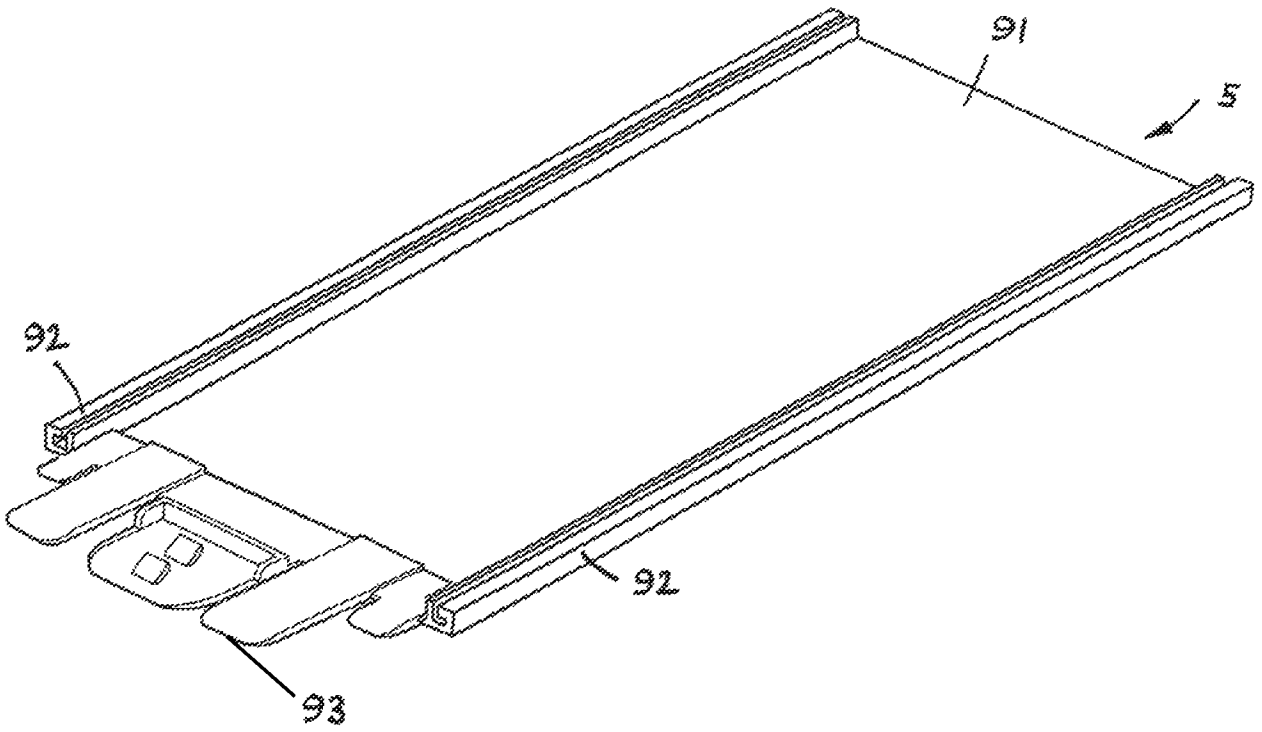
FIG. 3 PRIOR ART
FIG. 3 is a perspective view of a known prior art lid, suitable for use with the known prior art carrier shown in FIG. 1.

FIG. 3 illustrates a lid 5 for use with the carrier 1 shown in FIG. 1. The lid 5 comprises a generally flat plate 91 and two longitudinal side portions 92 which fit slidingly into the channels 74 of the carrier 1. At its front end, the lid 5 comprises a second insert 93.

Figure 4:
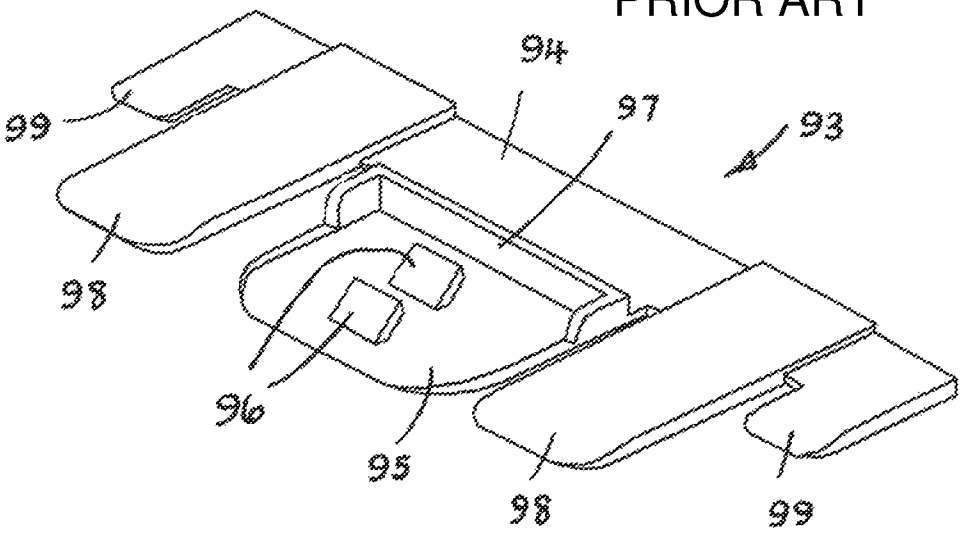
FIG. 4 PRIOR ART
FIG. 4 is a perspective view of part of the known prior art lid shown in FIG. 3.

As is shown in FIG. 4, the second insert 93, comprises a second elongate plate 94 from which extends forwardly a tongue 95. This tongue 95 is adapted to fit within the central box section 79 of the carrier 1. The tongue 5 includes serrate projections 96 which are positioned and adapted to engage the raised serrations 80 unidirectionally, such that once engagement is achieved, the respective parts must be broken to allow separation of the lid and carrier. Across the tongue 95 and behind the serrate projections 96, a barrier wall 97 closes the mouth of the central box section 79 of FIG. 2, when the lid 5 is fully inserted into the carrier 1.

At each side of the tongue 95, there is a respective first projection 98. When the lid is inserted fully into the carrier, the first projections 98 extend through the corresponding apertures 78 between the central box section 79 and the respective open side box sections 77 of the carrier 1. At each end of the second insert 93, there is a respective second projection 99 received by a respective side box section 77 of the lid 1.

Each of the first insert 75 and the second insert 93 may be secured within the carrier and lid respectively by adhesive or heat treatment. Of course, in alternative arrangements, it is possible that they may be integrally formed with the carrier and lid, respectively.

Figure 5:
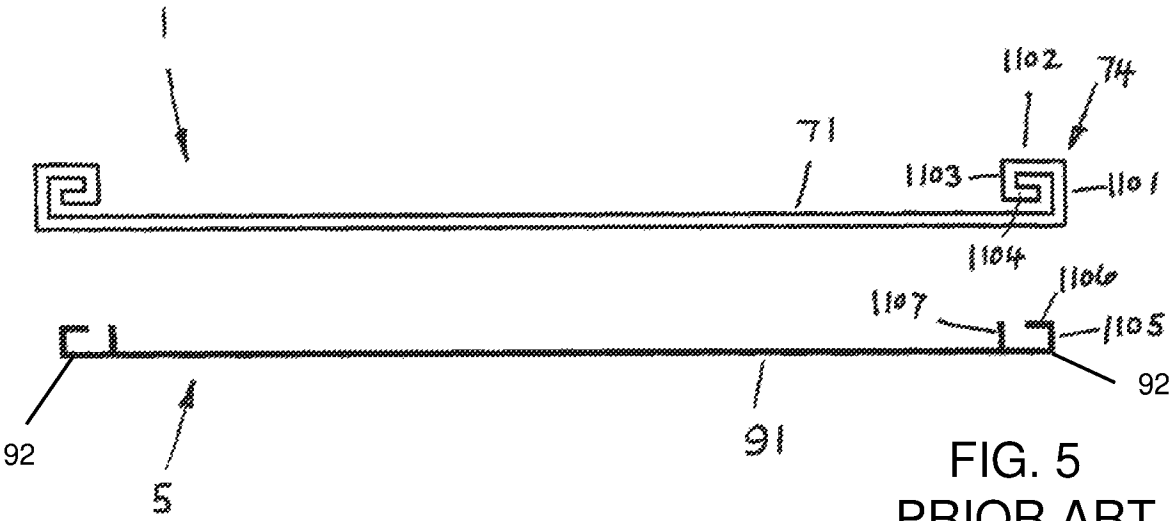
FIG. 5 PRIOR ART
FIG. 5 illustrates sectional views of the known prior art carrier and lid shown in FIGS. 1 and 3.

FIG. 5 shows the carrier 1 and the lid 5 in section. Each channel 74 comprises (as shown only for the right-hand channel in FIG. 5) an outer channel side wall 1101, a top channel wall 1102 parallel to the base 71, an inner channel side wall 1103 and a lateral channel flange 1104 which extends from the bottom of the inner channel side wall back into the channel 74, leaving a gap between the channel 74 and the base 71. Except for this gap the channel 74 is a closed section. The plate 91 of the lid 5 has an outer lid side wall 1105 at its lateral extremity. This outer lid side wall 1105 has an inwardly extending lid flange 1106. The outer lid side wall 1105 and the lid flange 1106 match and interlock with the inner space defined by the outer channel side wall 1101, the top channel wall 1102, the inner channel side wall 1103, and the lateral channel flange 1104 of the channel 74. The lid flange 1106 engages the channel flange 1104 in the vertical direction to resist separation of the lid 5 and carrier 1 at their side margins. The plate 91 also has an inner upstanding wall 1107 which extends upward to engage the inner side of the inner wall 1103 of the channel 74. It will be seen that the plate 91 of the lid fits into the gap to close the channel 74.

Figure 6:
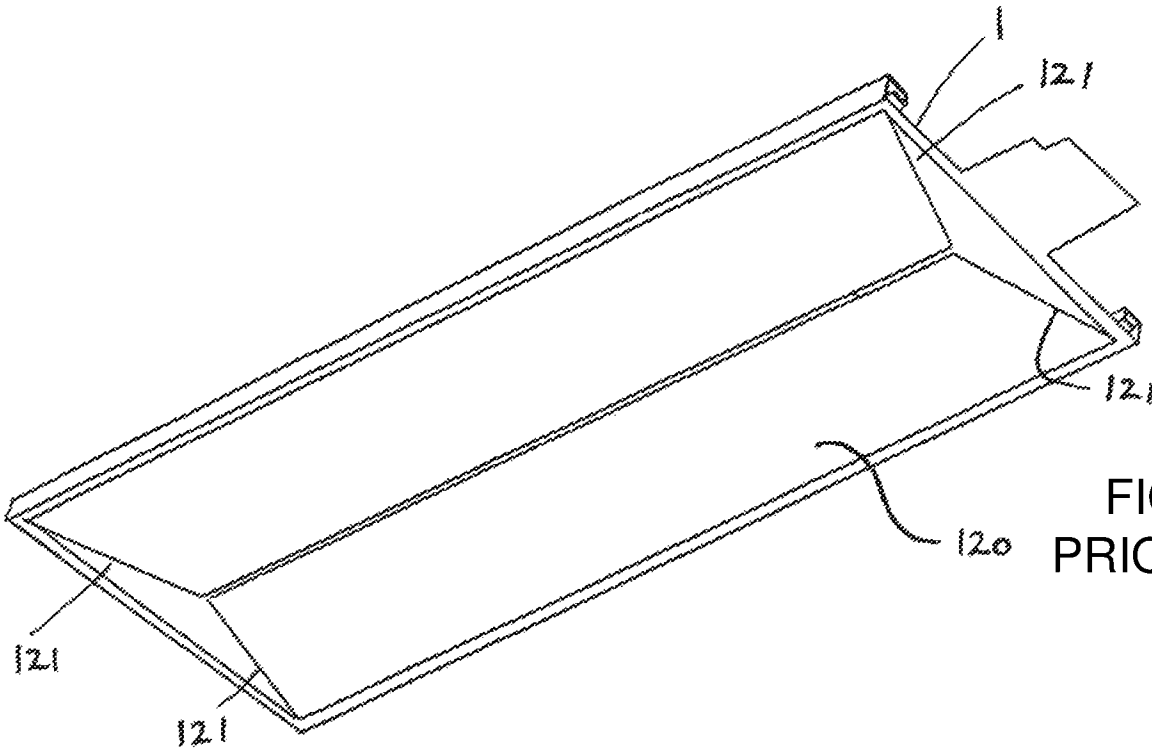
FIG. 6 PRIOR ART
FIG. 6 is a perspective view from below of a known prior art carrier having a bag for bank notes attached to it.
Figure 7:
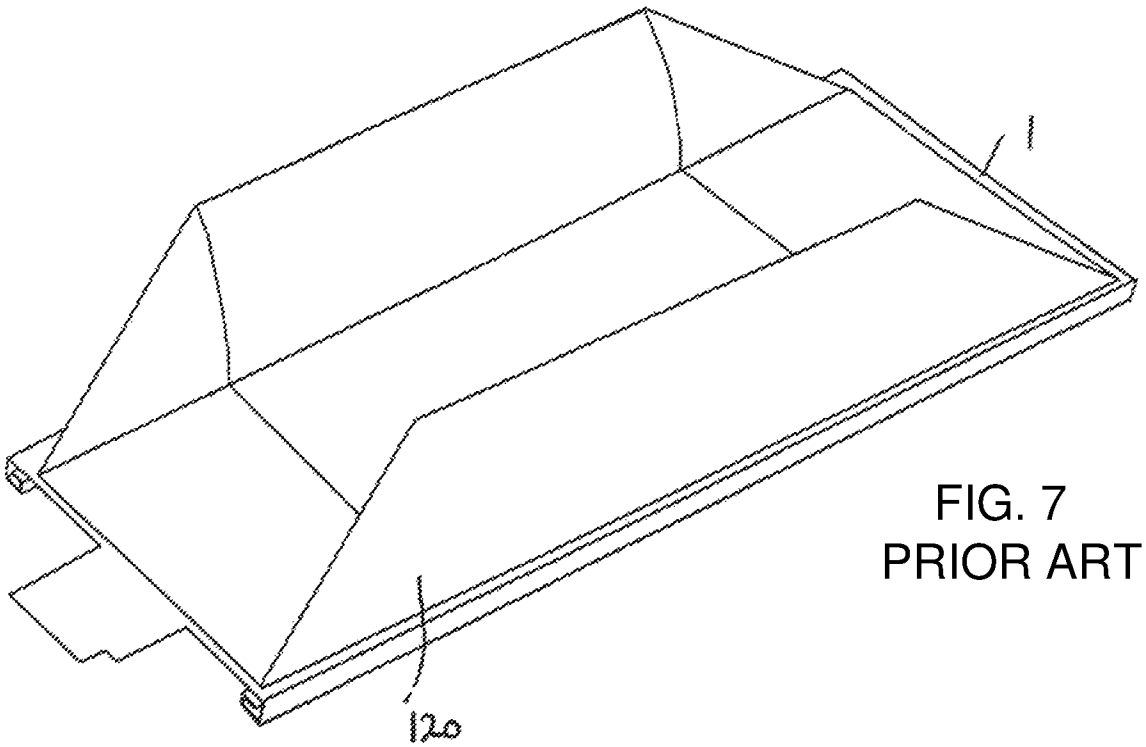
FIG. 7 PRIOR ART
FIG. 7 is another perspective view of the known prior art carrier and bag shown in FIG. 6.
Figure 8:
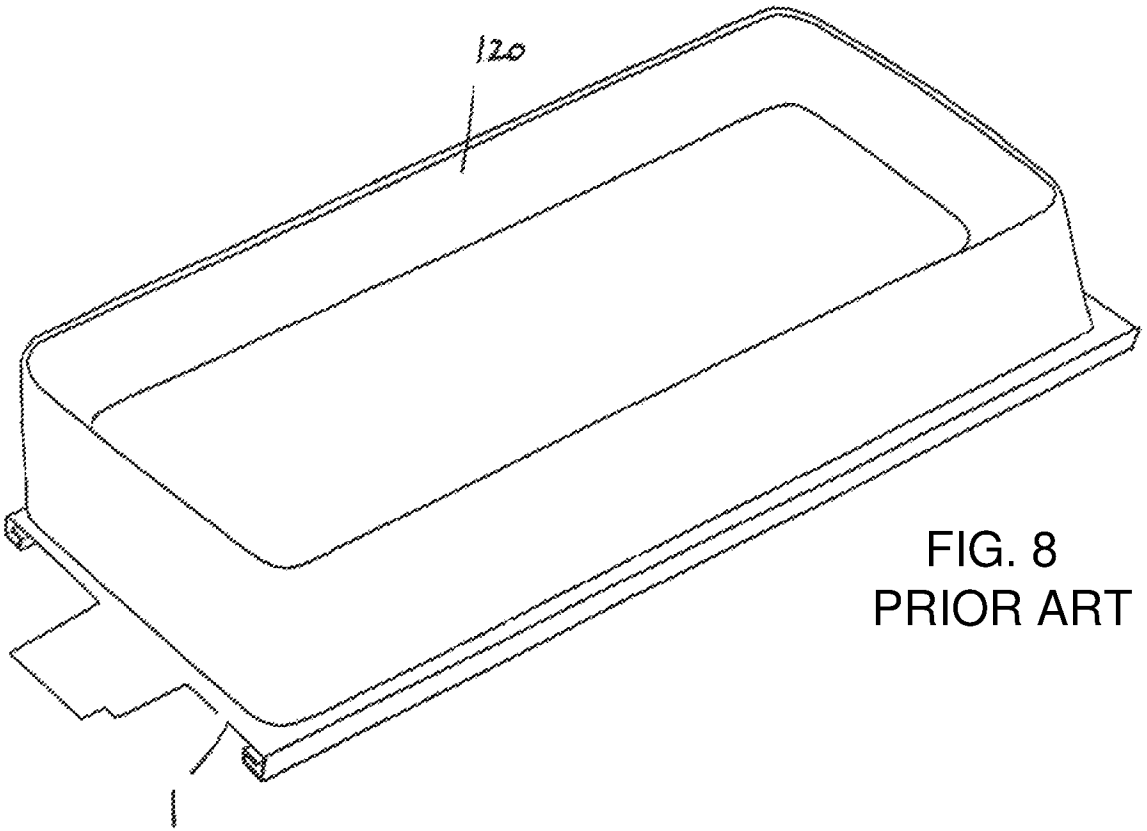
FIG. 8 PRIOR ART
FIG. 8 is a further partial perspective view of the known prior art carrier and bag shown in FIG. 6.

FIGS. 6 to 8 illustrate the carrier 1 and an attached bag 120 which is intended for use with a mechanism that includes a spring loaded platform below the bag 120. The bag 120 has a rectangular mouth secured to the margins of and below the carrier 1 and four corner pleats 121 which allow the bag 120 to fold flat as shown in FIG. 6. FIG. 7 shows the bag 120 partially expanded and FIG. 8 shows the bag 120 fully expanded, at which time the enclosed bank notes will fill the bag and be held under the flaps in the carrier 1. The use of such a bag in conjunction with a sprung supporting platform renders the use of an elasticated bag unnecessary.

Other formations of the bag 120 may be adopted, such that the bag can expand from a folded, flat configuration to a full state below the carrier.

FIGS. 9 to 13 show a lock 100 (FIG. 13), according to a first embodiment of the present invention. The lock 100 comprises a first member 101 (See FIGS. 9-10) shaped to form an irreversible lock with a correspondingly shaped second member 102 (See FIGS. 11*a*-11*b*). The first member 101 can be a male member and the second member 102 can be a female member. In alternative arrangements these may be swapped. An apparatus of the present invention comprises a carrier 1 and a lid 5 in accordance with that described by reference to FIGS. 1 to 8 with a lock 100, according to FIGS. 9-13. In one embodiment, the second insert 93 is modified/replaced with the first member 101 as the male member and the first insert 75 is modified/replaced with the second members 102 as the female member. In another embodiment, the second insert 93 is modified/replaced with the second member 102 as the female member and the first insert 75 is modified/replaced with the first member 101 as the male member in accordance with the present invention. Such an apparatus will comprise a carrier 1 being adapted to receive bank notes or the like. The carrier 1 has the channels 74 into which the lid 5 can be slid to prevent access to the bank notes in the carrier 5, the channels 74 of the carrier 1 having means (as seen in FIG. 5) for engaging with side portions 92 of the lid 5, the lid 5 having a leading edge with the first member 101 shaped to form an irreversible lock 100 with the correspondingly shaped second member 102 on the carrier 1.

The lock 100 will now be described in greater detail with reference to the apparatus. It is to be noted, however, that the lock 100 may be taken independently of such apparatus for application in various alternative fields. All of the features discussed herein may be applied to such a lock 100 in such other fields. It is further to be noted that for provision of a tamper proof lock/apparatus, as is an aim of the present invention, it will be sufficient that the lock 100 may not be opened without the same being evident.

Moreover, in accordance with the aspects discussed in the introductory portion of the specification above, various elements may be taken in isolation or in combination with one another.

FIGS. 9, 10, 11*a*, and 11*b* illustrate a lid 5, a carrier 1, and lock 100, according to the present invention. The lid 5 comprises a generally flat plate 91 and two longitudinal side portions 92, similar to the lid 5 in FIG. 3. The side portions 92 can similarly fit slidingly into the channels 74 of a carrier 1 of FIG. 1. The embodiment of the lid 5 comprises the second insert 93 at a front end of the plate 91 that may be separately formed to the lid or may be integrally formed. The lid may comprise a single piece moulding, as shown, which is preferred.

Figure 9:
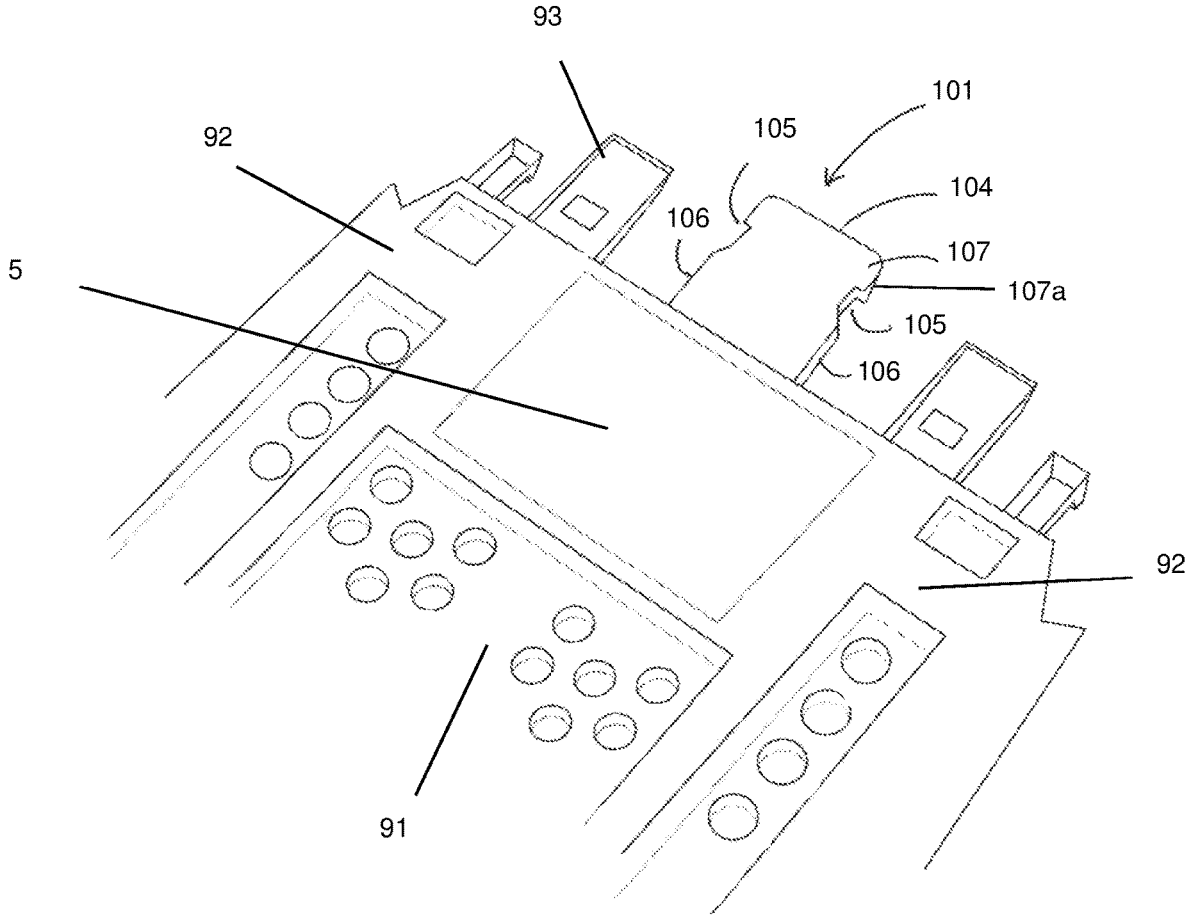
FIG. 9 is a top perspective view of a male member of a lock according to the present invention.
Figure 10:
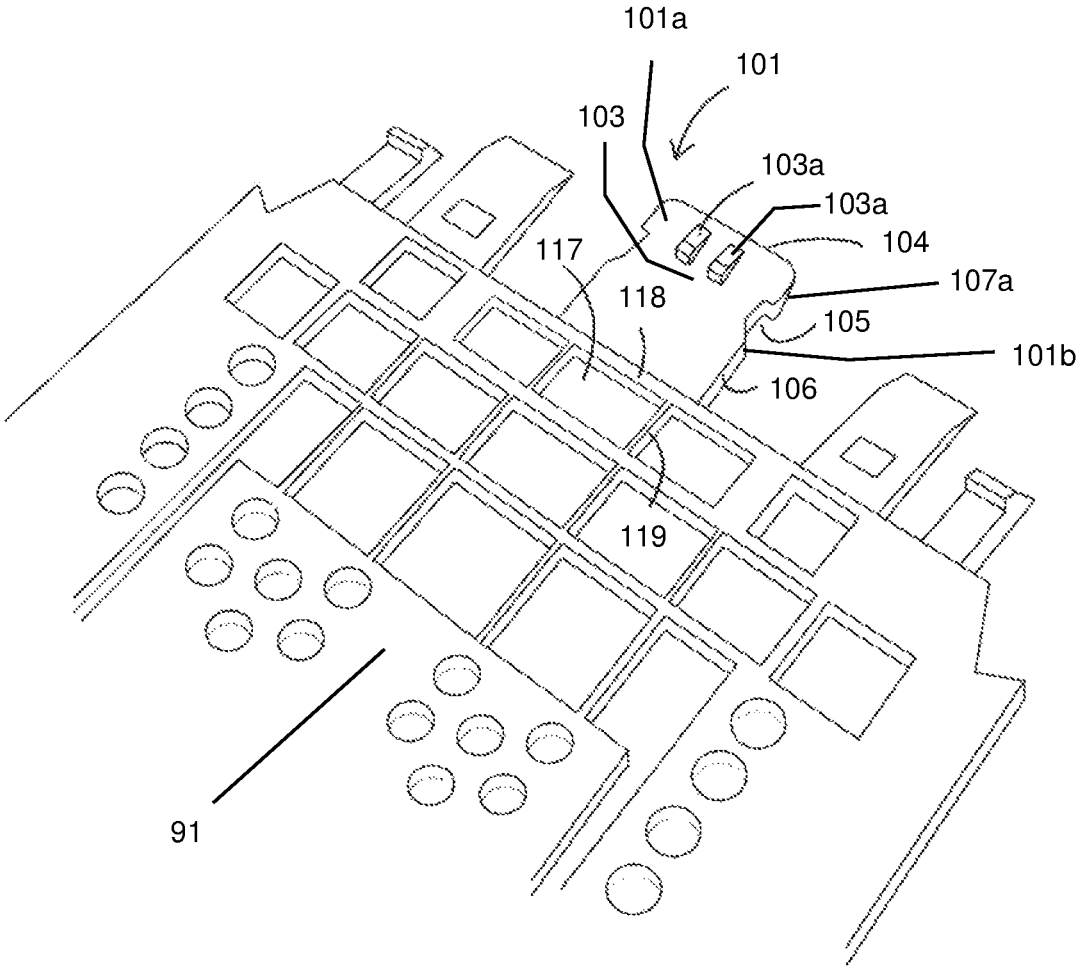
FIG. 10 is a bottom perspective view of the male member of FIG. 9.
Figure 11A:
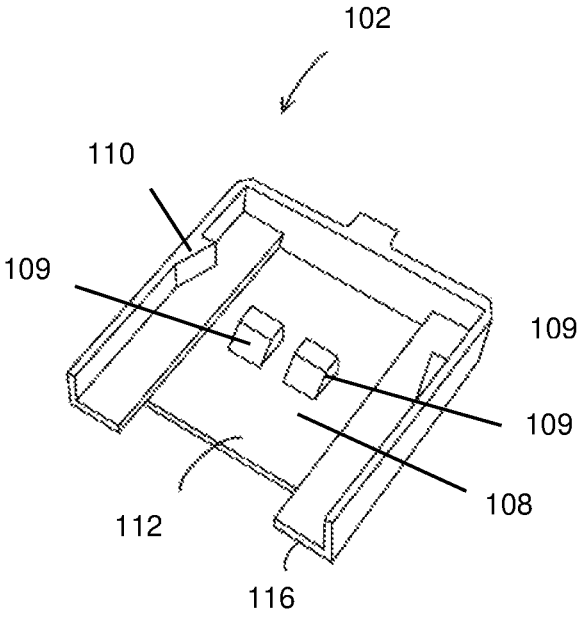
FIGS. 11*a* and 11*b* are partial top perspective views of alternative female members of a lock according to the present invention.
Figure 11B:
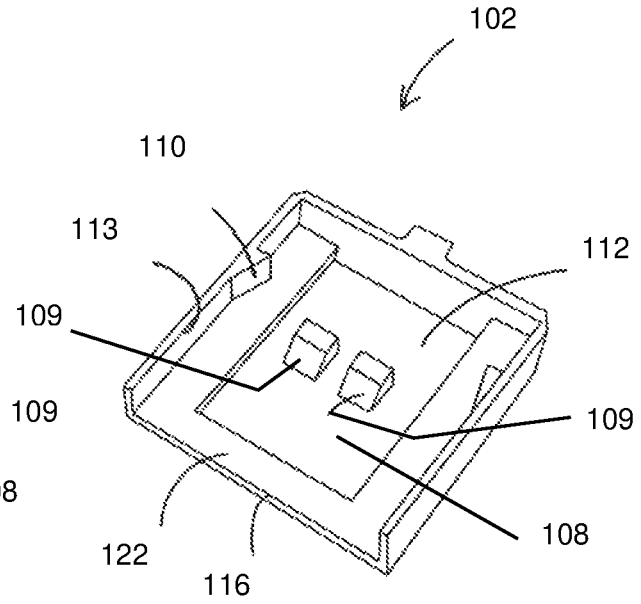

The lock 100 of the present invention replaces the tongue 95 of the prior art second insert 93 of the lid with the first member 101 as a male member and replaces the central open box section 79 of the first insert 75 of the carrier with the second member 102 as a female member. The first member 101 is comprised of a male serrate part 103. As shown in FIGS. 9-10, the male serrate part 103 is comprised of male ramps 103A, projecting in a direction normal to the plane of the lid. The second member 102, as the female member, includes alternative arrangements of which are shown in FIGS. 11*a* and 11*b*. The second member 102 comprises a female serrate part 108, which projects in a direction normal to the plane of the second member 102 (and normal to the plane of the lid, when the lid and the carrier are engaged). The first member 101 further comprises a first interlocking part 105, which lies in the plane of the lid. The second member 102 further comprises a second interlocking part 110, which projects in the plane of the second member (and in the plane of the lid, when the lid and carrier are engaged). The male serrate part 102, the female serrate part 108, the first interlocking part 105, and the second interlocking part 110 are respectively positioned to engage one another to prevent withdrawal of the lid from the carrier.

Figure 12:
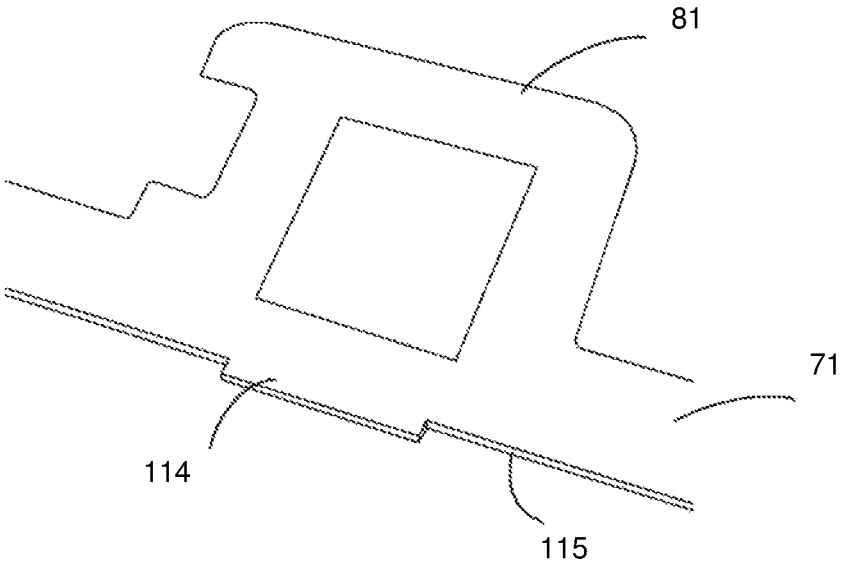
FIG. 12 is a partial perspective view of a leading portion of a frame of the carrier with the insert that defines the female member removed.
Figure 13:
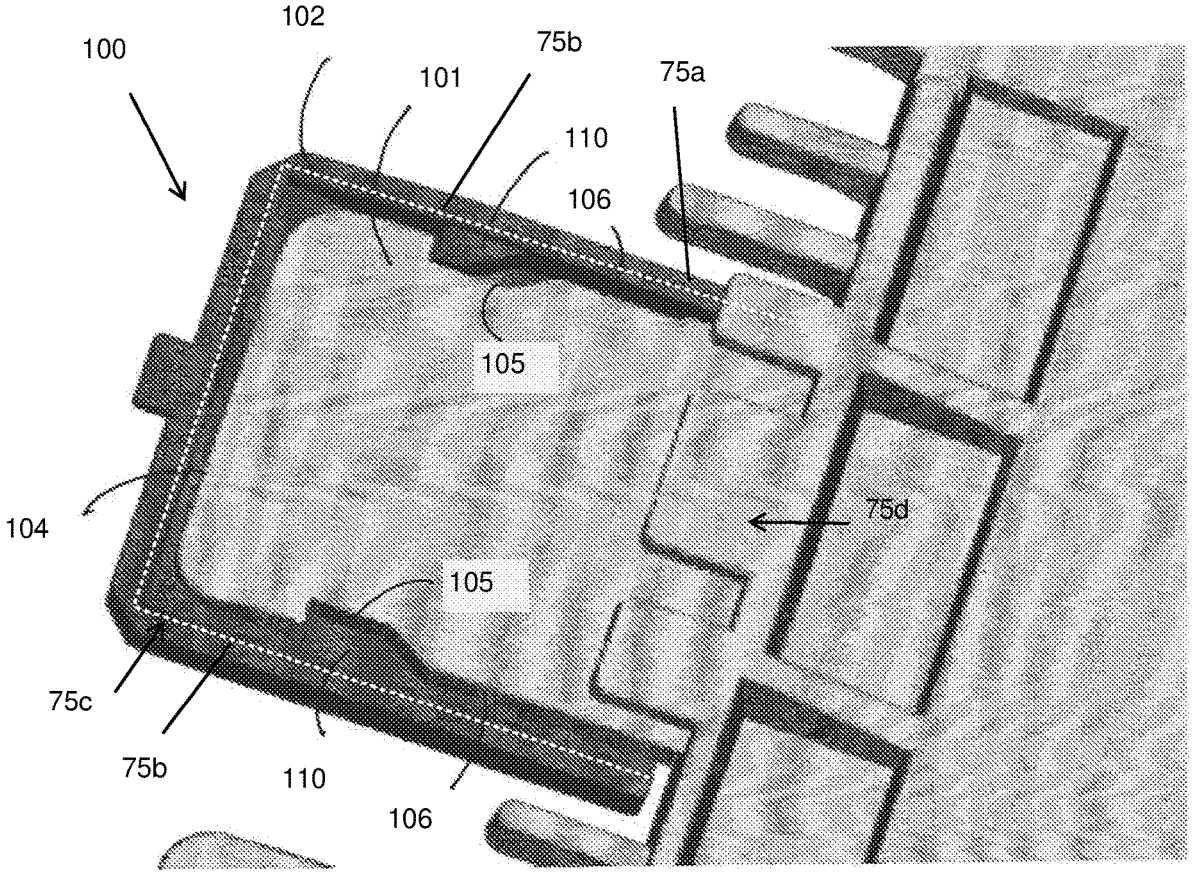
FIG. 13 is a partial top perspective view of the lock according to the present invention in an engaged state.

The female serrate part 108 of the second member 102 comprises a female ramp 109, which is arranged such that engagement of the female ramp 109 by the male serrate part 103 of the male member (in particular by a male ramp 103*a* of the male serrate part 103 of the male member) during insertion of the first member 101 into the second member 102, causes the first member to be spaced from a surface 112 of the second member 102 from which the female serrate part 108 of the second member 102 projects, the spacing permitting a portion of the first member 101 to pass over the second interlocking part 110 of the second member 102, thereby permitting an interlocking engagement of the first interlocking part 105 and second interlocking part 110, as shown in FIG. 12.

As clearly shown in the arrangement of FIGS. 9-13, there are multiple serrate parts and multiple interlocking parts on each of the first member 101 and the second member 102 as male and female members. The first member 101 comprises a pair of spaced male ramps 103*a* that are aligned with one another in the sliding direction. The second member 102 comprises a corresponding pair of female ramps 109. The second member 102 further comprises a pair of second interlocking parts 110, in the form of projections, which are provided on opposed sidewalls 113 and project toward one another. The first member 101 further comprises a pair of first interlocking parts 105, in the form of notches 105 formed in side edges of the first member 101. The notches are arranged to least partially receive the projections.

The first member 101 comprises a front edge 104, which is the forward most point of the first member 101 as the male member in an insertion/sliding direction of first member 101 into the second member 102 as the female member. The front edge 104 enters the second member 102 as the female member first during engagement of the first member and the second member. The male ramps 103*a* are provided adjacent the front edge 104. They are both spaced from the front edge 104 by the same distance. The male ramps 103*a* are forwards of the first interlocking parts 105 of the first member 101 in the sliding direction, i.e. they are spaced further from the front edge than the male ramps 103*a*.

It is to be understood that there could be more or less of either or both the serrate parts and the interlocking parts. They may further be formed differently, i.e. larger or smaller, or otherwise arranged. The invention is not to be limited in this regard.

The first member 101 as the male member is preferably substantially planar, as clearly seen in the figures. As discussed above in respect of the arrangement of FIGS. 1 to 8, the male member preferably comprises a tongue.

A planar portion 101*a* of the first member 101 that passes over the second interlocking part of the second member 102 is spaced from/free from the male ramps 103*a*. The planar portion 101*a* is substantially planar. The planar portion 101*a* is preferably the thinnest part of the first member 101. In the present arrangement, the first interlocking part 105 is on aside edge portion 101*b* of the first member 101, spaced transversely outside the male serrate part 103.

Turning now to the second member 102 as the female member, the second surface 112 from which the female serrate part 108 projects forms a base of the female part 102. A top (omitted from FIGS. 11*a*, 11*b* and 13 for clarity) is provided which is spaced from the base in the direction normal to the plane of the lid. The top is substantially planar. The top is substantially closed, such that access to the female serrate part 108 and second interlocking parts 110 and male serrate part 103 and first interlocking part 105 is prevented. For this purpose, it may be entirely closed or could have one or more small openings. The top and base are joined by the second side walls 113, which extend between the base and top substantially normal to the lid and base.

The top of the second member 102 as the female member may have a sloped front portion that receives a correspondingly shaped first sloped front portion 107*a* of a top face 107 of the first member 101, as seen in FIG. 9.

A spacing between the top and the interlocking parts 110 on the second member is preferably less than a spacing between lid and the female serrate part of the second member 102 as the female member.

As is apparent from the figures and description, noting that the top of the second member 102 as the female member is omitted for clarity, the female member comprises a hollow formation 75*c* that is substantially closed except for an open mouth 75*d*. The arrangement is preferably such that the first member 101 as the male member substantially closes off the mouth of the female member when the male and female members have formed an irreversible lock.

The arrangement as described herein is such that when the first member 101 as the male member is inserted into the second member 102 as the female member, the male ramps 103*a* and the female ramps 109 will engage one another. From an initial position, the male ramps 103*a* will ride up the female ramps 109. This will cause the first top face 107 and first sloped front portion 107*a* of the planar body of the first member (from which the male serrate part 103 projects) to be increasingly spaced from the base 112 of the second member 102. The first top face 107 and first sloped front portion 107*a* as portions of the first member 101, have planar sides, are spaced from/free from the male serrate part 103, and are located forward of the first interlocking parts/notches 105. The front edge 104 with the first top face 107 and first sloped front portion 107*a* will pass through the space between the second interlocking members 110 of the second member 102 and the top 75*a* with second top side walls 75*b* of the second member 102 as the female member. As the male serrate part 103 and the female serrate part 108 clear one another, and the second interlocking parts 110 are aligned with the notches that form the first interlocking parts 105. The first member 101 will resile (since it is no longer forcibly spaced from the base or second surface 112), and the first interlocking part 105 will engage the second interlocking part 110. An irreversible lock in two planes is formed.

Whilst the use of male and female members 101, 102 as described above (comprising serrate parts, which project in a direction normal to the plane of the lid, and interlocking parts) is preferred, there may be arrangements where the male and female members are otherwise formed.

Further aspects, which may be taken in isolation from one another or in any combination with one another, and which may be combined with the above described male and female members 101, 102 or taken independently thereof, will now be described. Whilst these additional aspects will be described in the context of an embodiment comprising the above described male and female members 101, 102 this is not to be limiting. For example, the arrangement of FIGS. 1 to 8 could be amended to form an embodiment of the present invention by the introduction of one or more or all of the following aspects (whilst omitting the use of the above described male and female members 101, 102).

In one aspect, a shield 114 is provided which projects from, or from adjacent to, the mouth of the second member 102 as the female member. The shield 114 is shown in FIG. 12, which represents a partial perspective view of a leading portion of the base 71 of the carrier with the insert that defines the second member 102 as the female member (as seen in FIGS. 11*a* and 11*b*) removed. As above, the second member 102 as the female member is preferably defined by a central box section that fits over the front tab 81 extending forwardly from the base 71 of the carrier 1. In the present arrangement, the shield is integrally formed with the base 71. However, various alternative arrangements will be readily conceived by those skilled in the art. Its projection from the mouth of the second member 102 as the female member in the present arrangement is as a result of the mouth of the second member 102 as the female member being substantially aligned with an edge 112 of the base 71 from which the shield 114 projects. In the present arrangement, the edge 116 of the insert defining the second member 102 as the female member, which edge 116 defines the mouth of second member 102 as the female member, is preferably aligned with the edge 115 of the base of the carrier.

The shield 114 is preferably provided on (or at least adjacent to) an edge of the mouth of the second member 102 as the female member that lies adjacent to the bag 120/ adjacent to the surface 112 of the second member 102 as the female member from which the female serrate part 108 of the second member 102 as the female member projects.

By the provision of the shield, access to the mouth of the second member 102 as the female member and/or access to the male serrate part 103 and the female serrate part 108 is significantly hindered, which further adds to the security of the apparatus. In this regard, it is important to note that the specific form of the shield and its means of formation/ attachment are not critical as long it projects from/adjacent from the mouth to shield access to the mouth.

The shield 114 preferably has a width substantially equal to the width of the first member 101, however, it is not particularly limited in this regard. It could be narrower or wider than the first member 101. It could be narrower, wider or substantially equal in width to the mouth of the female member 102.

The shield may be substantially planar, as shown in FIG. 12 or could have some alternative three-dimensional form. The projection from the mouth need not be significant for the shield to be effective. In the present embodiment it projects from the mouth by a distance of 5 mm or less, although this need not be the case.

In another aspect, a surface of the lid that faces the carrier comprises a recess 117 immediately adjacent to the first member 101 (male member in the present embodiment), as shown in FIG. 10. The recess is separated from the first member 101 by a rib 118, which is preferred but need not be the case. In the present embodiment there are three recesses provided immediately adjacent the first member 101, which are arranged in a row. The first member at least partially spans all three of the recesses in the width direction as shown. The recesses are separated from one another by ribs 119. It should be appreciated that there could be more or less recesses provided. A single recess only could be provided. Moreover, as shown, there may be multiple rows of recesses to form a grid like pattern of separating ribs. Whilst the recesses are rectangular in form in the present embodiment and are arranged in rows this need not be the case.

By the provision of the recess, access to the mouth of the second member 102 as the female member and/or access to the male serrate part 103 and the female serrate part 108 is yet further hindered, which further adds to the security of the apparatus. A tool is likely to enter the recess (or one of the recesses where multiple recesses are provided) rather than the mouth. In this regard, it is important to note that the specific form/arrangement of the recess (or recesses) is not critical as long it hinders access to the mouth.

In yet further aspects, a barrier 122 is provided inside the second member 102 as the female member immediately adjacent the mouth as shown in FIG. 11*b* and/or a barrier is provided inside the second member 102 as the female member so that it is spaced between the mouth and the female serrate part 108 of the second member 102 as the female member as also shown in FIG. 11*b*.

FIG. 11*a* shows an alternative second member 120 as the female member in which the barrier 122 is omitted.

The barrier may substantially span the width of the mouth. It may span the width of the first member 101 as the male member. It may span the width of the portion of the first member 101 that is provided with the male serrate part 103 or second member 102 that is provided with the female serrate part 108.

The barrier 122 most preferably projects from the surface 112 of the female member from which the female serrate part 108 of the second member 102 as the female member projects. The barrier 122 may have a flat surface that lies spaced from and parallel to the second surface 112 of the female member, as shown. The barrier may comprise a rib.

It is to be noted, however, that the form of the barrier is not particularly limited. The purpose of the barrier is to provide a further obstruction to any tool that a would be thief may seek to insert through the mouth of the second member 102 as the female member for disengaging the lock. The barrier has the further benefit that it will obstruct the passage of male serrate part 103 of the first member 101 during any attempted release of the first member 101 as the male member from the second member 102 as the female member. In this regard, the barrier could be formed as a further serrate part.

In a final aspect a trailing edge of the carrier (not shown) comprises a third member (not shown) shaped to form an irreversible lock with a correspondingly shaped fourth member (not shown) on the carrier, one of the third and fourth members comprising a male member and the other of the third and fourth members comprising a female member, and a cover fixed to the lid for covering the third member to prevent access thereto.

The cover is preferably fixed to a face of the lid that faces away from the carrier when the lid and carrier are engaged. The cover is fixed such that its removal will be evident. It may be welded or adhered to the lid.

The third member is preferably unitarily formed with the lid. It may be integrally moulded with the lid.

The third member preferably comprises a serrate part, which unidirectionally engages with a corresponding feature on the carrier.

The form of the cover is not particularly limited as long as access to the third member is blocked. The cover will completely cover the third member.

It is to be noted that as with the first and second members, there may be multiple third and fourth members provided or only a single third member and single fourth member.

Additional, preferred, features of the apparatus, which may be incorporated into any of the above described embodiments/combined with any of the above described aspects include:

The provision of a plurality of holes in the lid, which are formed to allow some or all of the contents of the bag 120 of the carrier to be marked in the event of tampering and to prevent withdrawal of the contents therethrough and/or such holes within the bag 120 itself.

The provision of covering tabs for covering some or all of the openings to the channels 74 of the side portions of the carrier. Such covering tabs may be formed by the second member.

I claim:

1. An apparatus comprising:

a lid being comprised of side portions and a first member;

a carrier being comprised of channels in removable engagement with said side portions, and a second member; and a lock being comprised of said first member in an irreversible lock position relative to said second member, said first member being in male-female engagement with said second member, said first member being male and being insertable into said second member being female, wherein said first member has a planar portion with a front edge and side edge portion, and a first top face, wherein said first member is comprised of a male serrate part having male ramps projecting in a direction normal to a plane of said lid, and a first interlocking part on said side edge portion, wherein said second member has second surface and a second side wall, wherein said second member is comprised of a female serrate part having female ramps projecting in a direction normal to a plane of said second surface, and a second interlocking part on said second side wall, wherein said male serrate part is locked to said female serrate part in said plane of second surface and said plane of said lid and said first interlocking part is locked to said second interlocking part in another plane of said second side wall and said side edge portion in said irreversible lock position so as to prevent withdrawal of said lid from said carrier, and wherein said male ramps are in sliding engagement with said female ramps in an initial position so as to space said planar portion and said first top face from said second surface and pass said front edge over said second interlocking part until said male serrate part is locked to said female serrate part in said plane of second surface and said plane of said lid and said first interlocking part is locked to said second interlocking part in another plane of said second side wall and said side edge portion in said irreversible lock position.

2. The apparatus, as claimed in claim 1, wherein said first top face is planar.

3. The apparatus, as claimed in claim 1, wherein said first member is a tongue.

4. The apparatus, as claimed in claim 1, wherein said planar portion is comprised of a first sloped front portion between said front edge and said first interlocking part, said first sloped front portion being planar.

5. The apparatus, as claimed in claim 4, wherein said first sloped front portion is spaced from said male serrate part.

6. The apparatus, as claimed in claim 1, wherein said second surface forms a base, and wherein said second member further comprises a top spaced from said base in the direction normal to said plane of said lid.

7. The apparatus, as claimed in claim 6, wherein spacing between said top and said second interlocking part is less than spacing between said lid and said female serrate part.

8. The apparatus, as claimed in claim 6, wherein said top covers said base.

9. The apparatus, as claimed in claim 8, wherein said top and said base form a hollow formation with an open mouth.

10. The apparatus, as claimed in claim 9, wherein said first member closes a portion of said open mouth in said irreversible lock position.

11. The apparatus, as claimed in claim 6, wherein said top is comprised of a second top side wall extending normal to said lid and said base, wherein said second side wall is joined to said second top side wall, said second interlocking part projecting from said second side wall into said plane of said lid.

12. The apparatus as claimed in claim 11, wherein said top is comprised of another second top side wall extending normal to said lid and said base, wherein second member is further comprised of another second side wall and another second interlocking part, and wherein said another second side wall is joined to said another second top side wall, said another second interlocking part projecting from said another second side wall in said plane of said lid.

13. The apparatus, as claimed in claim 1, wherein said first interlocking part comprises a notch and wherein said second interlocking part comprises a projection, said projection being at least partially received by said notch in said irreversible lock position.

14. The apparatus, as claimed in claim 1, wherein said front edge is a forward most point of said first member in an insertion direction extending along an insertion axis of said first member and said second member, and wherein said male serrate part is adjacent said front edge.

15. The apparatus, as claimed in claim 14, wherein said male ramp is between said first interlocking part and said front edge.

16. The apparatus, as claimed in claim 1, wherein said first member is comprised of another male ramp and another first interlocking part, and wherein said second member is comprised of another female ramp and another second interlocking part.

17. A lock, comprising:

a first member; and a second member, said first member in an irreversible lock position relative to said second member, said first member being in male-female engagement with said second member, said first member being male and being insertable into said second member being female, wherein said first member has a planar portion with a front edge and side edge portion, and a first top face, wherein said first member is comprised of a male serrate part having male ramps projecting in a direction normal to a plane of said lid, and a first interlocking part on said side edge portion, wherein said second member has second surface and a second side wall, wherein said second member is comprised of a female serrate part having female ramps projecting in a direction normal to a plane of said second surface, and a second interlocking part on said second side wall, wherein said male serrate part is locked to said female serrate part in said plane of second surface and said plane of said lid and said first interlocking part is locked to said second interlocking part in another plane of said second side wall and said side edge portion in said irreversible lock position so as to prevent withdrawal of said lid from said carrier, and wherein said male ramps are in sliding engagement with said female ramps in an initial position so as to space said planar portion and said first top face from said second surface and pass said front edge over said second interlocking part until said male serrate part is locked to said female serrate part in said plane of second surface and said plane of said lid and said first interlocking part is locked to said second interlocking part in another plane of said second side wall and said side edge portion in said irreversible lock position.

* * * * *